United States Patent [19]

MacKenzie

[11] 3,999,350

[45] * Dec. 28, 1976

[54] CONSTRUCTIONAL ELEMENT

[76] Inventor: James A. MacKenzie, 100 Bronson Ave., Ottawa, Ontario, Canada

[ * ] Notice: The portion of the term of this patent subsequent to July 20, 1993, has been disclaimed.

[22] Filed: Jan. 20, 1976

[21] Appl. No.: 650,744

Related U.S. Application Data

[63] Continuation of Ser. No. 571,862, April 25, 1975, which is a continuation of Ser. Nos. 143,272, May 13, 1971, abandoned, and Ser. No. 879,181, Nov. 24, 1969, abandoned.

[52] U.S. Cl. ..... 52/633; 46/29; 52/105

[51] Int. Cl.[2] ..... E04B 1/18

[58] Field of Search ..... 52/633, 634, 635, 636, 52/637, 638, 105, 342, 581; 46/29, 31

[56] References Cited

UNITED STATES PATENTS

| | | | |
|---|---|---|---|
| 2,632,533 | 3/1953 | Mackenzie | 52/633 |
| 2,990,920 | 7/1961 | Hoffman | 52/633 |
| 3,003,600 | 10/1961 | MacKenzie | 52/633 |
| 3,043,409 | 7/1962 | Kremer et al. | 52/633 |
| 3,127,961 | 4/1964 | Frazier | 52/633 |

FOREIGN PATENTS OR APPLICATIONS

| | | | |
|---|---|---|---|
| 205,727 | 3/1959 | Austria | 52/633 |
| 84,573 | 5/1955 | Denmark | 52/633 |
| 82,263 | 10/1953 | Denmark | 52/633 |
| 1,110,138 | 2/1956 | France | 52/633 |
| 573,688 | 2/1958 | Italy | 52/633 |
| 763,214 | 2/1956 | United Kingdom | 52/633 |

*Primary Examiner*—Price C. Faw, Jr.
*Assistant Examiner*—Leslie Braun
*Attorney, Agent, or Firm*—Depaoli & O'Brien

[57] ABSTRACT

A constructional element of constant L-shaped cross-section formed by two metal flanges joined together at right angles has in each flange at least one row of regularly-spaced apertures extending longitudinally thereof. Each row comprises alternate circular apertures and non-circular apertures, the latter being elongated both parallel to and transversely to the length of the element. The rows of apertures in the flanges closest to the junction are offset with respect to each other so that the circular holes in one row register transversely with the non-circular holes in the other row. By the provision of non-circular apertures elongated in two directions, the versatility of the element when used in the fabrication of structural units and frameworks is enhanced.

1 Claim, 32 Drawing Figures

CONSTRUCTIONAL ELEMENT

RELATED APPLICATIONS

This application is a continuation of application Ser. No. 571,862, filed Apr. 25, 1975, which in turn is a continuation of application Ser. No. 143,272, filed May 13, 1971 and Ser. No. 879,181, filed Nov. 24, 1969, both now abandoned.

BACKGROUND OF THE INVENTION

1. Field of Invention

This invention relates to constructional elements of L-shaped cross-section comprising two metal flanges joined together at right-angles each flange having at least one row of regularly spaced holes or apertures extending longitudinally thereof. Elements of this type cut to suitable lengths can be secured together by fixing means inserted through registering holes or apertures to form a variety of structural units and frameworks.

2. Description of Prior Art

Constructional elements of the type referred to above are described in the specifications of my two earlier British Pat. Nos. 696,531 and 856,780.

In my earlier British Pat. No. 696,531 I disclosed a constructional element of constant thickness and of L-shaped cross-section having a narrow flange and a wide flange, a row of holes extending longitudinally of the narrow flange, and two rows of holes extending longitudinally of the wide flange, the minimum distance between the adjacent edges of adjacent holes in each row being the same throughout each row, said distance being the same in the case of each of the three rows, the row of holes in the narrow flange and the two rows of holes in the wide flange being repetitions of one another and each consisting of a plurality of alternate round and elongated holes, the round holes all being of the same size, the elongated holes all being of the same diameter, said elongated holes being elongated transversely of the element, said elongated holes being of a width equal to the diameter of one of the round holes and of a length equal to the diameter of one of the round holes plus twice the thickness of the element, the round holes in any given row of holes being transversely aligned with the elongated holes in the next adjacent row of holes.

I later found that the element of my first mentioned patent could be rendered substantially more versatile by radically changing the number, shape, and arrangement of holes in the inner row of holes in the said wide flange; and in the L-shaped element disclosed in my later British Pat. No. 856,780 the said row consists of a plurality of holes which are alternately elongated transversely and longitudinally of the member, the transversely elongated holes being similar in size to the transversely elongated holes in the other two rows and the longitudinally elongated hole being of the same width as one of the round holes in the other two rows and of a length at least as great as the centre-to-centre distance between two of the transversely elongated holes in one of said other rows plus the diameter of one of said round holes.

I now find that the utility of such a constructional element can be further improved by altering the configuration of the holes or apertures to provide in each row a series of round holes alternating with holes which are elongated both in the longitudinal and transverse direction of the element.

SUMMARY OF THE INVENTION

According to the present invention, at least one flange of the constructional element has a row of apertures comprising apertures of a first type alternating with apertures of a second type, the apertures of the first type being capable of accommodating a fastener such as a bolt without appreciable play in the plane of the flange, whereas the apertures of the second type are arranged to afford the fastener a play of predetermined magnitude, preferably equal to twice the thickness of the flange, both parallel to and transversely of the length of the element, the apertures of the second type being elongated in both said directions for this purpose.

The first type apertures are preferably, though not essentially, circular in form and designed for use with cylindrical bolts, and the second type apertures accordingly are preferably in the form of quatrefoils defined by arcuate curves of radius equal to that of the circular apertures.

Two or more such rows of apertures can be provided in a flange and where such rows are provided in both flanges of the element the rows of apertures closest to the junction between the flanges are mutually offset so that the first type apertures in one of said closest rows register transversely with second type apertures in the other closest row, adjacent rows of apertures in anyone flange being likewise mutually offset.

It is envisaged that in a constructional element as defined above wherein two or more such rows of apertures are provided on one flange, an auxiliary row of first-type apertures may be provided at a location spaced between the outermost row of said apertures and the free edge of the flange, said auxiliary first-type apertures registering transversely with the second-type apertures in said outermost row but not themselves being interspaced by second-type apertures. Thus for a given length of constructional element the numbers of apertures in said auxiliary row will be equal to half the number of apertures in the remaining rows of the same flange.

Preferably the lateral spacing between the rows of apertures in a flange is equal to one-half the spacing, longitudinally of the element, of identical apertures in each row the spacing of the innermost row of apertures in a flange from the inner surface of the adjacent flange is preferably greater than one-half the spacing, longitudinally of the element, of identical apertures in each row plus the thickness of the flange. The spacing of the outermost row of apertures on a flange from the free edge of the flange is preferably equal to half the spacing of identical apertures longitudinally of the element.

BRIEF DESCRIPTION OF DRAWINGS

The advantages of my novel form of constructional element will become apparent from the following detailed description of several embodiments thereof, given by way of example only, taken in conjunction with the accompanying drawings in which.

DESCRIPTION OF PREFERRED EMBODIMENTS

Referring first to FIGS. 1, 1A, 2 and 2A there is shown a constructional element 9 comprising an L-section metal angle bar having flanges 1 and 2 of equal width and arranged mutually at right angles, the element being of constant cross-section and uniform thickness. In each of the flanges 1 and 2 is provided a line of apertures extending longitudinally thereof, circular apertures 6 alternating with non-circular apertures 7, and the circular apertures in one flange registering transversely with the non-circular apertures in the other flanges as shown.

Figure 1:
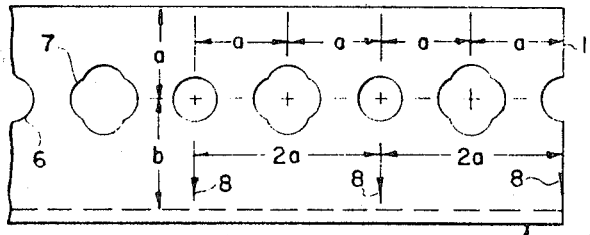
FIGS. 1, 2, 1A and 2A are respectively a top plan view, a side elevation and two end sectional views of one form of constructional element.
Figure 1A:
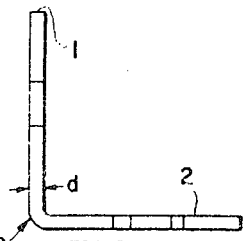
Figure 6:
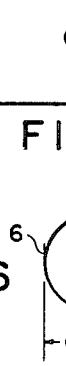
FIGS. 6 and 7 are detailed views to an enlarged scale showing the form of apertures provided in the constructional elements illustrated in FIGS. 1 to 5.
Figure 7:
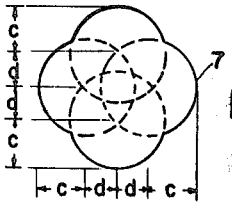

The apertures are shown in more detail in FIGS. 6 and 7, the circular apertures or holes 6 having a radius $c$ and the non-circular apertures or guatrefoils being elongated both longitudinally of and transversely of the length of the element. As will be clearly seen from FIG. 7 each quatrefoil 7 is defined by four regularly arranged intersecting arcuate curves of radius $c$ the maximum dimension of the quatrefoil in each of its directions of elongation being equal to $2c$ plus $2d$ where $d$ is the thickness of the flanges of the element. As shown in FIG. 1 the centre-to-centre distance of adjacent holes 6 along each flange equals $2a$, the quatrefoils 7 being arranged symmetrically at regular intervals with respect to the holes. The distance between the line joining the centre of the holes and the free edge of the flange 1 is $a$, while the distance between this line and the plane of the inner surface of flange 2 is $b$. The dimension $b$ should be not less than the dimension $a$, and in practice, for reasons which will become apparent from the following description, will usually be slightly larger.

The cons.ructional element may be provided in standard lengths, cutting indication marks 8 being provided at regular intervals to facilitate cutting of the element into suitable shorter lengths as required. The cutting indications 8 preferably coincide with the transverse line of symmetry of successive quatrefoils 7 in the flange 2, i.e. with the centres of successive holes in the flange 1.

Figure 2:
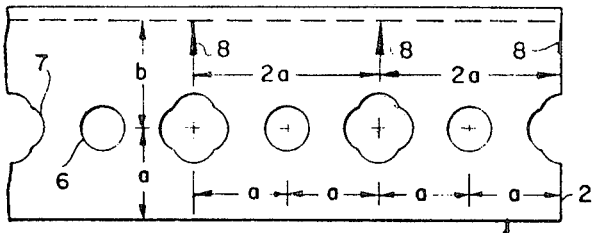
Figure 2A:
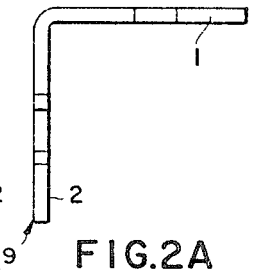
Figure 3:
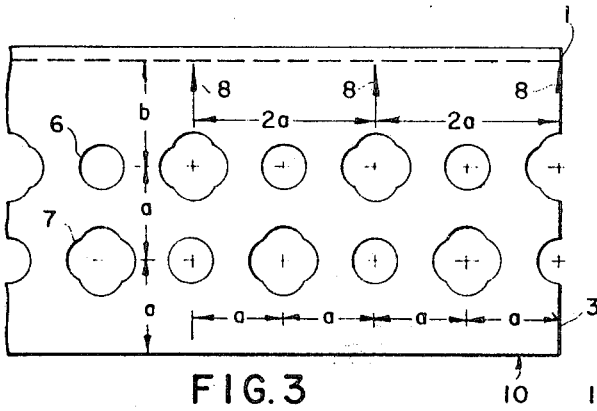
FIGS. 3, 4 and 5 are side elevations of alternative forms of constructional elements, the corresponding end sectional views being shown in FIGS. 3A, 4A and 5A respectively.
Figure 3A:
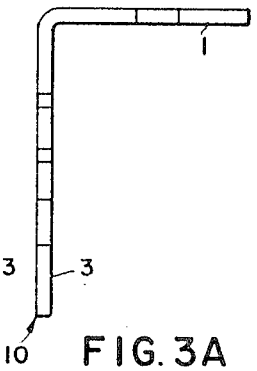
Figure 4:
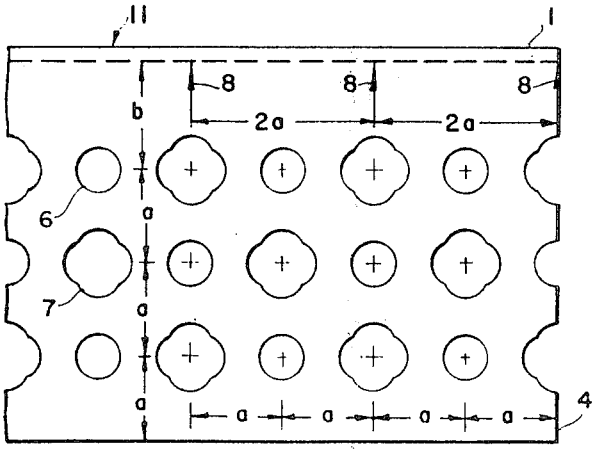
Figure 4A:
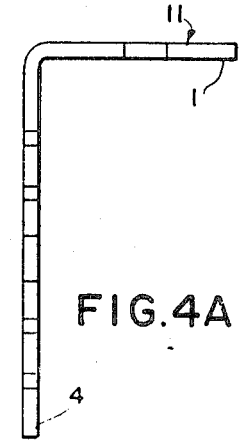
Figure 5:
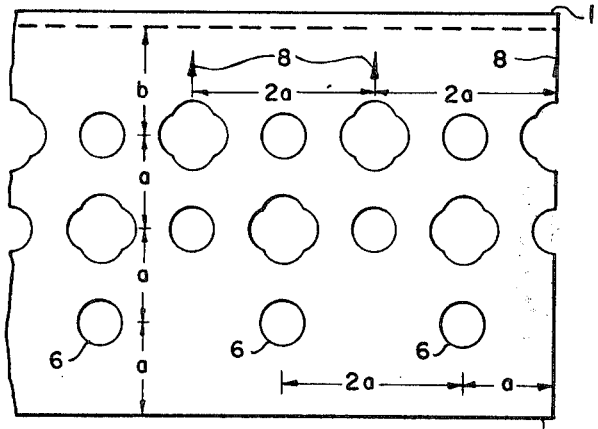
Figure 5A:
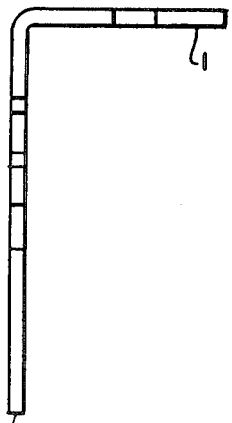

The constructional elements illustrated in FIGS. 3 to 5 are basically similar to the one shown in FIGS. 1 and 2 and like parts are indicated by the same reference numerals therein. In FIGS. 3 and 3A a constructional element 10 is shown having a flange 1 with a single line of apertures and a wider flange 3 having two lines of apertures as shown. The line of apertures nearest the free edge of flange 3 is arranged with the apertures thereof positioned in offset relationship with respect to the other line of apertures on that flange, i.e. the quatrefoils in one line are transversely aligned with the holes in the other line. The transverse distance between the centres of the lines of apertures on flange 3 is equal to $a$.

The constructional element 11 shown in FIG. 4 has a narrow flange 1 and a wide flange 4 provided with three rows of apertures 6 and 7, the apertures of these rows being offset so that the round holes in one row are transversely aligned with the quatrefoils in each adjacent row, the transverse spacing between the centres of the line of apertures being equal to $a$.

The constructional element 12 illustrated in FIG. 5 is generally similar to that shown in FIG. 4 but has a wide flange 5 in which the quatrefoils have been omitted from the outermost row of apertures which therefore comprises simply a series of holes 6 positioned at a centre-to-centre distance along the flange of $2a$.

Figure 8:
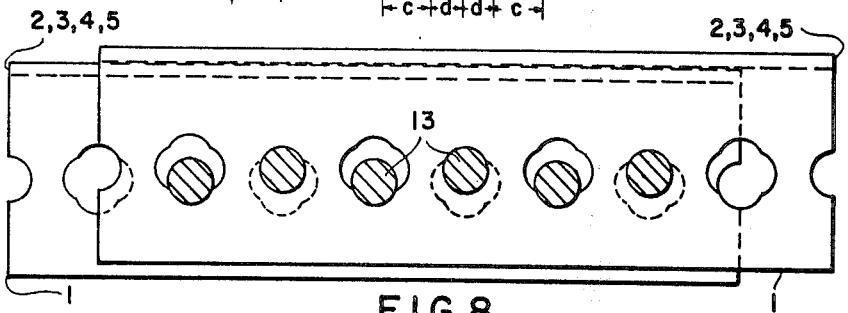
FIGS. 8 and 8A show repsectively a top plan view and a side elevation of an overlapping splice of two nested elements of the type shown in FIG. 4.
Figure 8A:
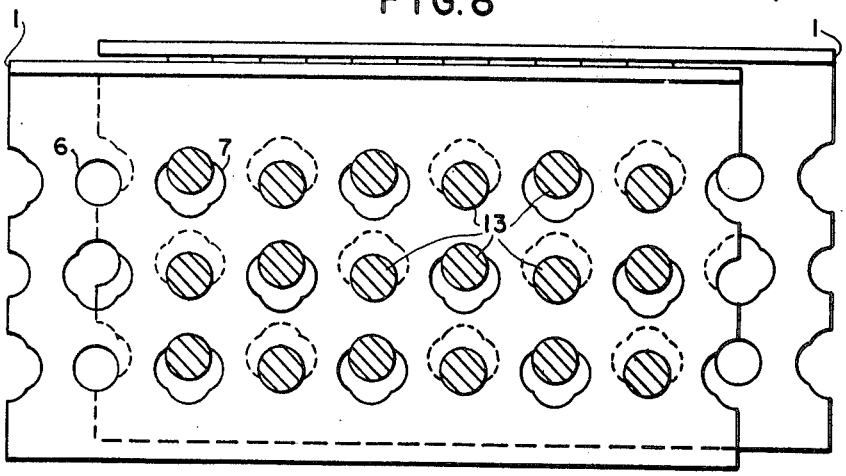

Referring now to FIGS. 8 and 8A there is illustrated the relationship assumed for forming an overlapping splice of two nested elements 11 of the type shown in FIG. 4 the holes 6 in the flange 1 of one of the elements being registered with the quatrefoils 7 in the corresponding flange of the other element.

It will be evident that because of the nested arrangement of the two elements, the lines of apertures in the flanges 1 will be mutually offset vertically by a distance $d$ equal to the thickness of the material of the elements.

The cross-hatched circles 13 in these views illustrate the area of overlap between these registering apertures and thus it will be clear that any or all of the aligned apertures may be employed for securing the two elements together as by the insertion of a fastener such as a bolt therethrough. It will be noted that each fastener provided to form this joint will be capable of withstanding both longitudinal and transverse bearing forces since the nature of the overlapping apertures affords no plan to the fastener.

Figure 9:
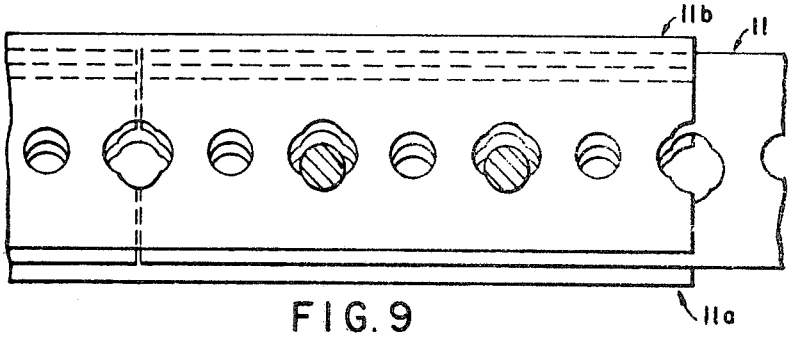
FIGS. 9 and 9A shown respectively a top plan view and a side elevation of a butt splice between elements of the type shown in FIG. 4.
Figure 9A:
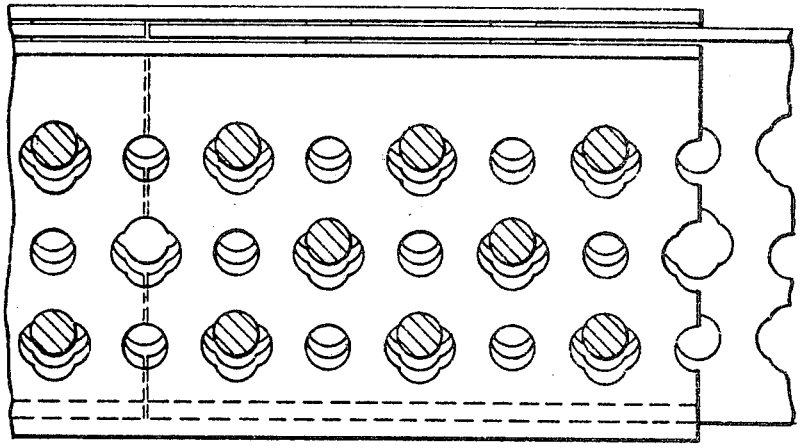

FIGS. 9 and 9A show the arrangement for forming a butt splice between two elements of the type shown in FIG. 4, the butt being strengthened by outer and inner elements $11b$, $11a$ on both sides of the joint. As shown in FIG. 9A the apertures in the flange 4 of the inner element are vertically offset from the apertures in the outer element by a distance of $2b$. However, by virtue of the shape of the quartrefoil apertures it is still possible to insert bolts through three nested elements as shown in the drawings. As an alternative to the arrangement shown in FIGS. 9 and 9A, the butt splice could also be made if the butted elements were moved laterally by a distance $a$ relative to the inner and outer elements. In this case the quatrefoil 7 of the inner and outer elements would register with the circular holes 6 of the butted element.

Figure 10:
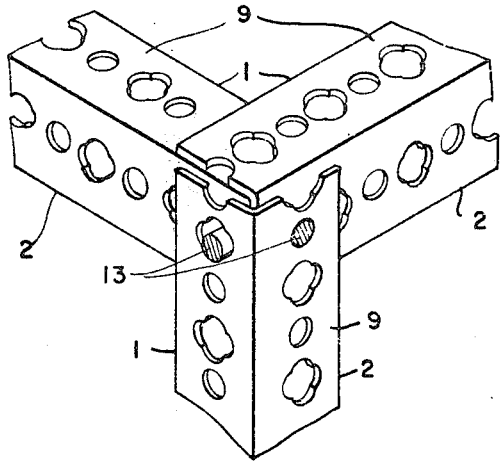
FIG. 10 is a perspective view showing a typical corner connection between constructional elements of the type shown in FIGS. 1 and 2.

FIG. 10 shows in perspective a corner connection between three constructional elements 9 of the type shown in FIG. 2 arranged mutally at right angles. The dimensions of the apertures 6 and 7 and their positions on the elements 9 are such that the connection may be secured by two bolts 13 inserted through registering apertures in the overlapping flanges, and lateral and vertical loads applied to the connection are applied as bearing loads upon both the bolts.

Figures 11, 12:
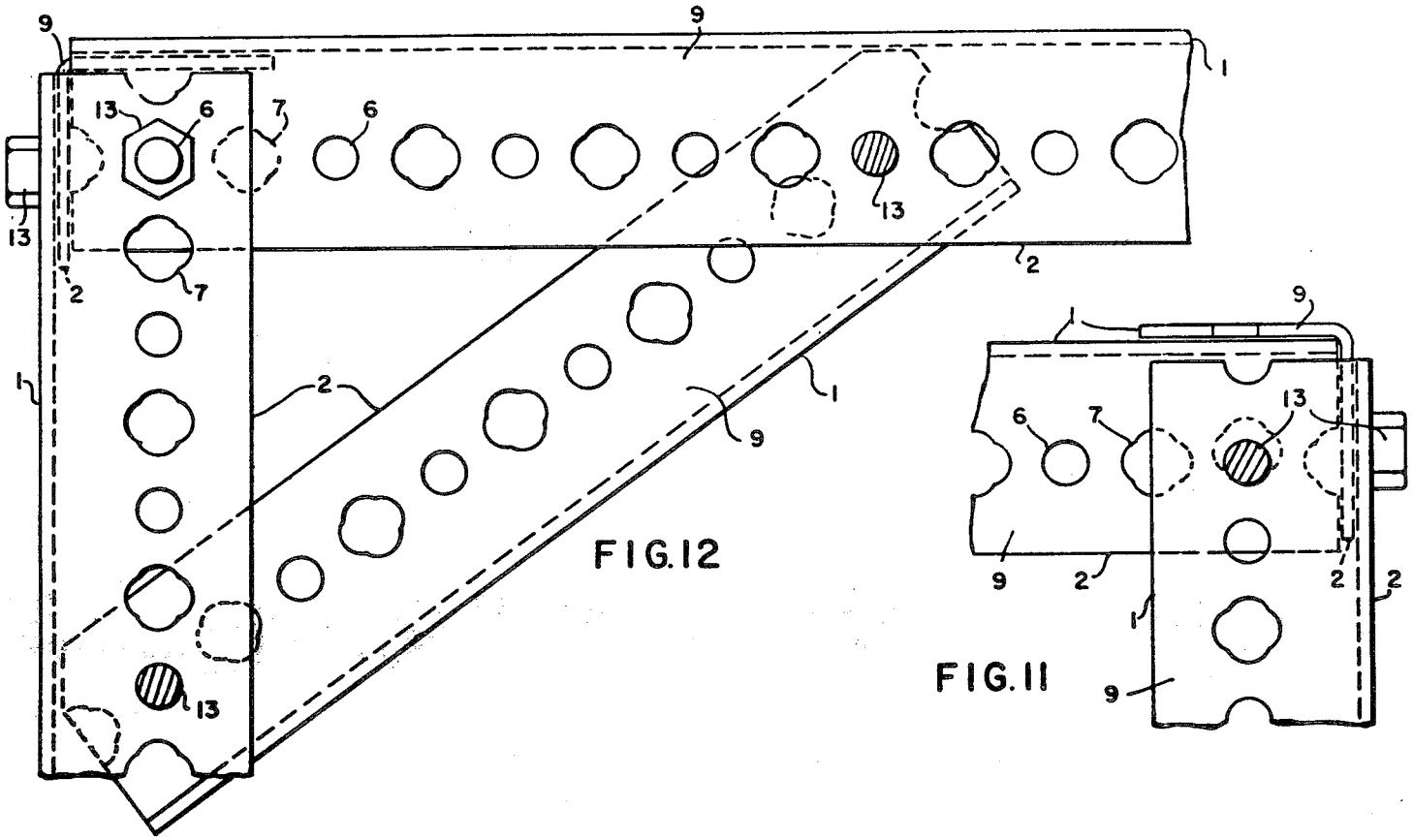
FIGS. 11 and 12 are side elevations of the corner connection shown in FIG. 10.

It will be observed that the constructional elements as shown in the drawings all include a small radius curvature at the junction of the flanges. Thus it will be appreciated that when elements are to be secured together at right angles as shown in FIGS. 10 and 11, the distance $b$ between the row of apertures and the other flange of the element should be greater than centre-to-centre distance $a$ between the apertures lengthwise of the element, if the elements are to be connected with the flanges of adjacent elements in face-to-face contact and the apertures properly registered. Preferably distance $b$ is equal to the sum of distance $a$, distance $d$ and an allowance for the radius at the flange junction.

The bolt 13 shown in plan view in FIG. 11 is in bearing between a quatrefoil 7 in flange 1 of the vertical member and a hole 6 in flange 2 of the horizontal member. The other bolt 13 is shown in FIG. 12 is in bearing between a hole 6 in flange 2 of the vertical member and a hole 6 in the flange 2 of the horizontal member. To strengthen the corner connection a diagonal brace may be added as shown in FIG. 12 and comprising a length of the element 9 bolted in position as shown.

Figure 13:
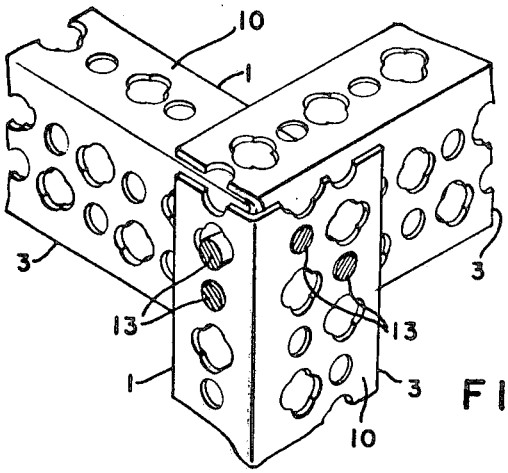
FIG. 13 is a perspective view of a typical corner connection using constructional elements of the type shown in FIG. 3.
Figure 14:
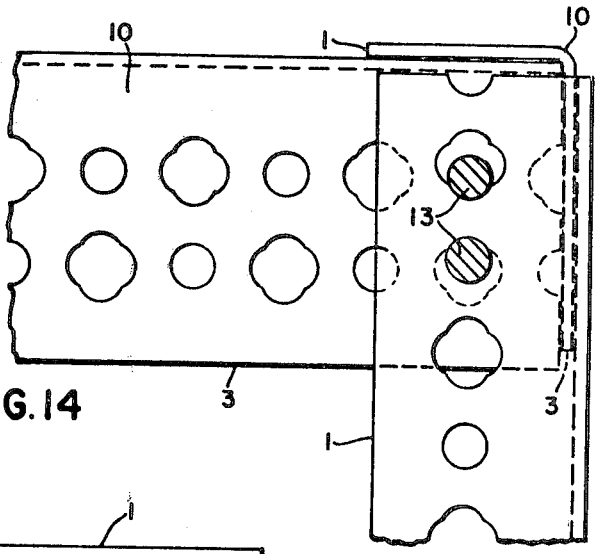
FIGS. 14 and 15 are respective side elevations of the connection shown in FIG. 13.
Figure 15:
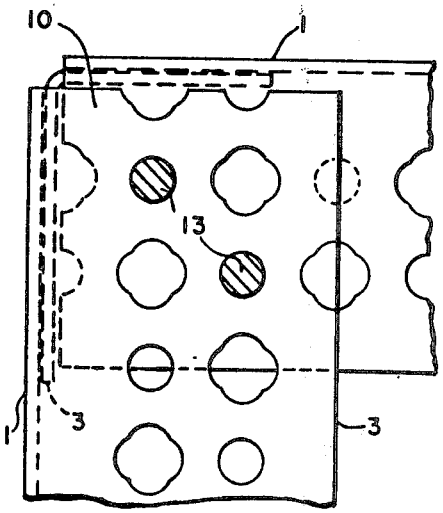

In forming the corner connection shown in FIGS. 13 to 15 a constructional element 10 of the type shown in FIG. 3 is employed and in this connection it is possible to arrange four bolts in bearing through the registering apertures indicated by the cross-hatched circles. As shown in FIG. 14 the narrow flange 1 of the vertical element is connected to the wide flange 3 of one of the horizontal elements. FIG. 15 shows two bolts joining two holes 6 in the wide flange 3 of the vertical member to two holes 6 in the wide flange 3 of one of the horizontal members.

Figure 16:
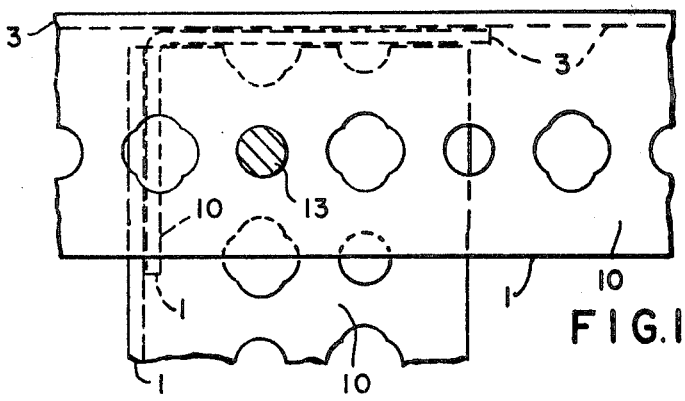
FIGS. 16 and 17 are side elevations of an alternative corner connection to that shown in FIGS. 13 to 15.
Figure 17:
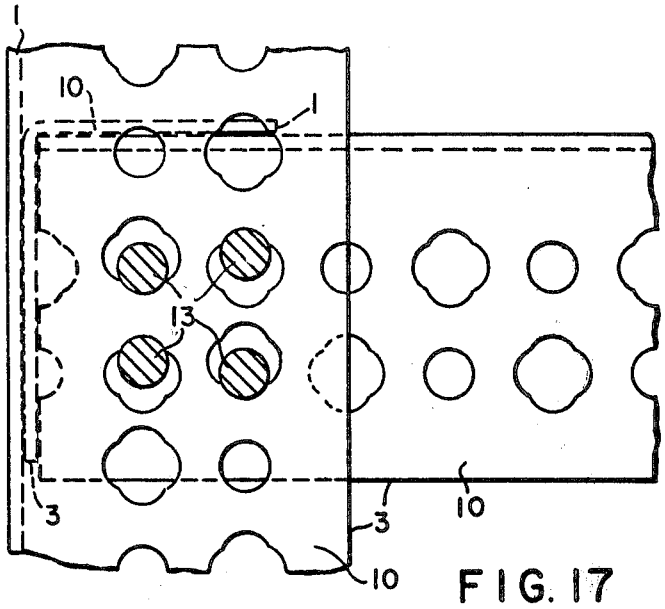

In the alternative connection arrangement shown in FIGS. 16 and 17 the horizontal elements 10 are joined to the vertical elements 10 at a location a distance $a$ vertically below the location shown in FIG. 13. Thus as shown in FIG. 16 one bolt 13 joins overlapping holes 6 in the narrow flange 1 of the vertical element and the wide flange 3 of one of the horizontal elements. If the wide flange 3 of the vertical element is connected to the wide flange 3 of the other horizontal element it would be possible to connect these overlapping flanges by four blots 13 loaded in bearing as shown in FIG. 17. Thus with this connection it is possible to position five bolts to withstand lateral and vertical bearing loads.

Figure 18:
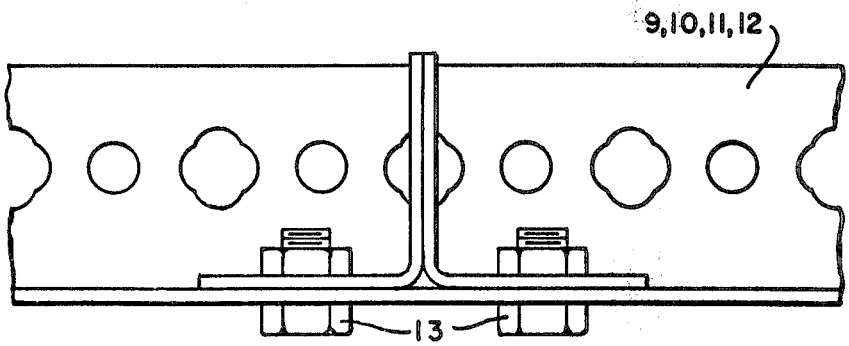
FIGS. 18 and 19 show respectively a top plan view and a front elevation of a T section connection between constructional elements of the type shown in FIGS. 1 and 2.
Figure 19:
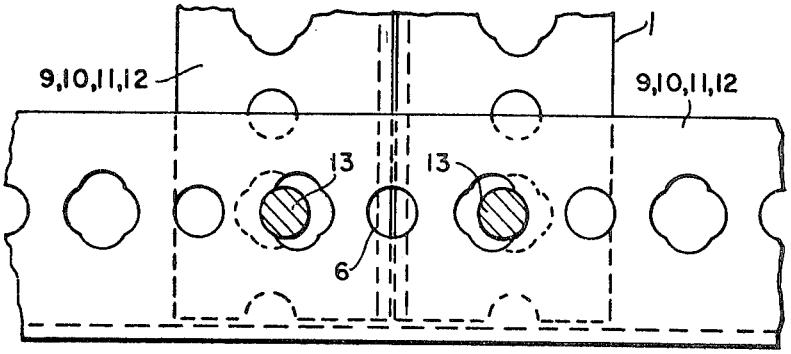

The inverted T connection shown in FIGS. 18 and 19 provides for the bolting of two "back-to-back" vertical elements to a common cross member, bolts 13 being inserted through the registering quatrefoils in the vertical and horizontal members and being loaded in bearing. Any of the constructional elements shown in FIGS. 1 to 5 may be employed in making such a connection. The centre-to-centre distance between the bolts 13 on the flange of the horizontal members is $2a + 2d$. This distance should correspond to the horizontal distance between the quatrefoils in the flanges 1 of the vertical elements which equals $2(b-d) + 2d$, i.e., $2b$.

Figure 20:
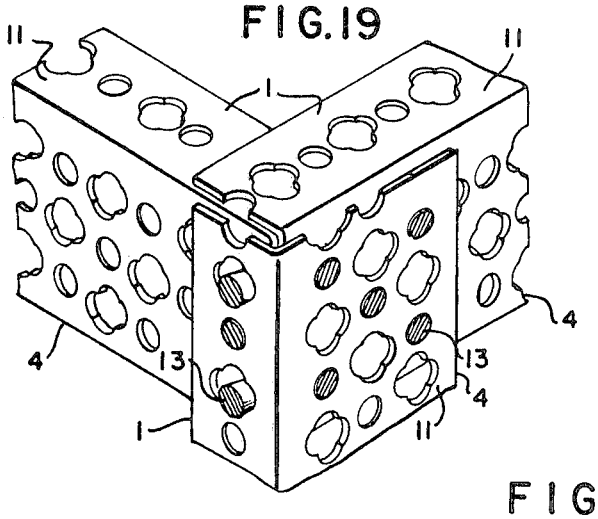
FIG. 20 is a perspective view of a typical corner connection using constructional elements of the type shown in FIG. 4.
Figure 21:
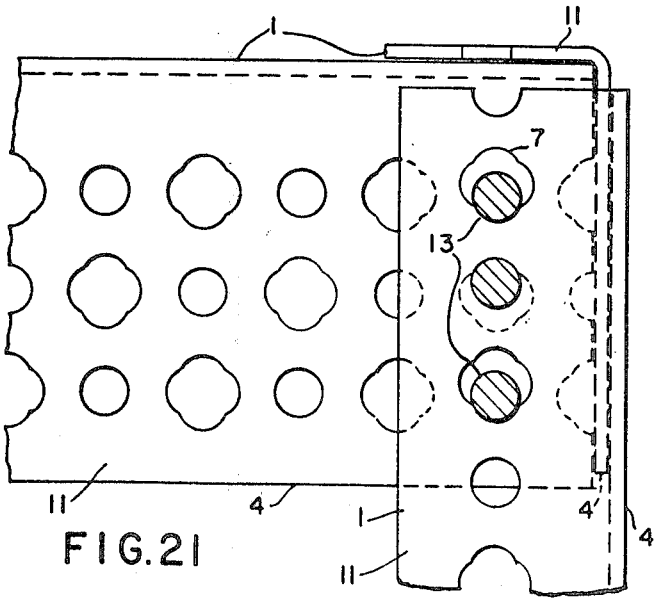
FIGS. 21 and 22 are side elevations of the corner connection shown in FIG. 20.
Figure 22:
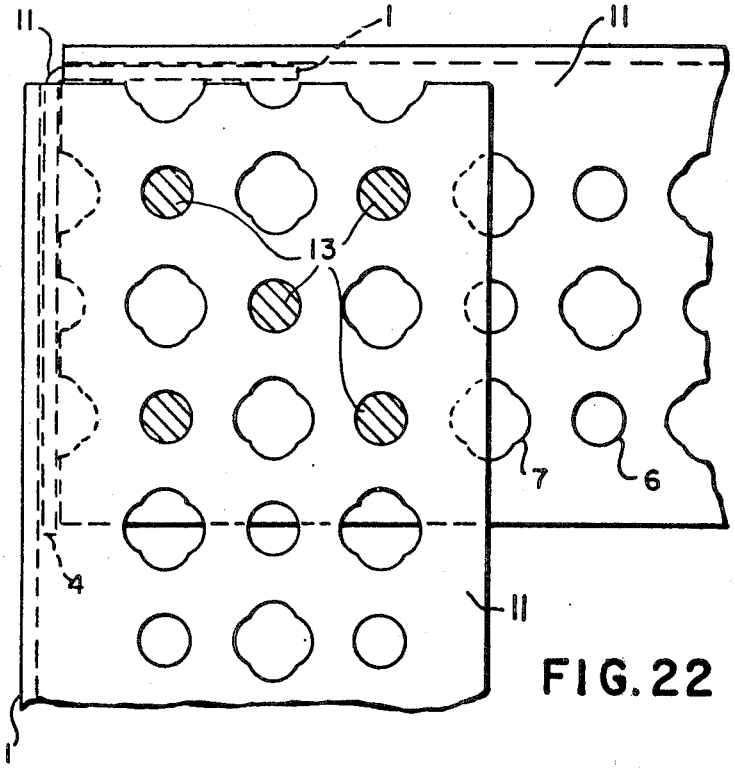

The corner connection shown in FIGS. 20 to 22 is similar to the one shown in FIG. 13 but employs three constructional elements 11 of the type shown in FIG. 4. As will be seen from FIGS. 21 and 22 this corner connection may be secured by a total of eight bolts in bearing inserted through the overlapping apertures.

Figure 23:
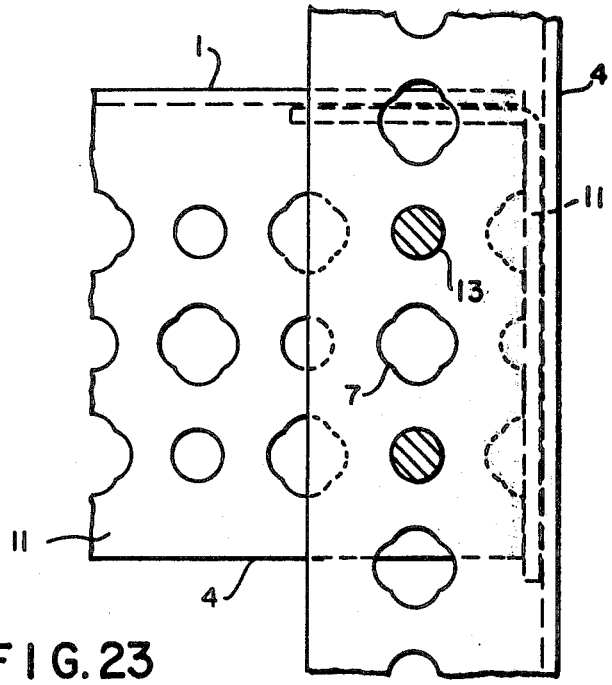
FIGS. 23 and 24 are side elevations of a corner connection arrangement alternative to that shown in FIGS. 20 to 22.
Figure 24:
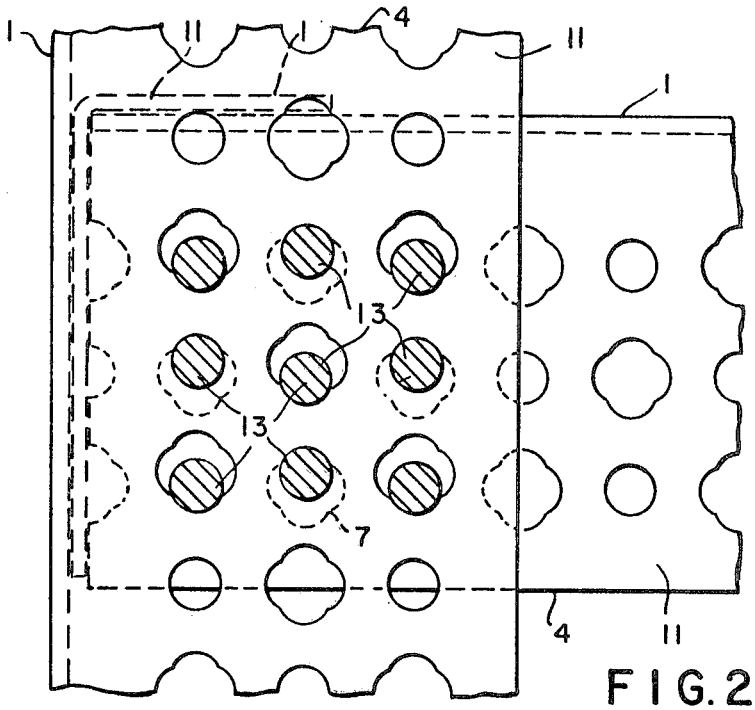

FIGS. 23 and 24 show a corner connection similar to that shown in FIG. 20 but with the horizontal elements displaced a distance $a$ vertically on the vertical element. This corner connection may be secured by a total of eleven bolts inserted through the overlapping apertures as shown.

Figure 25:
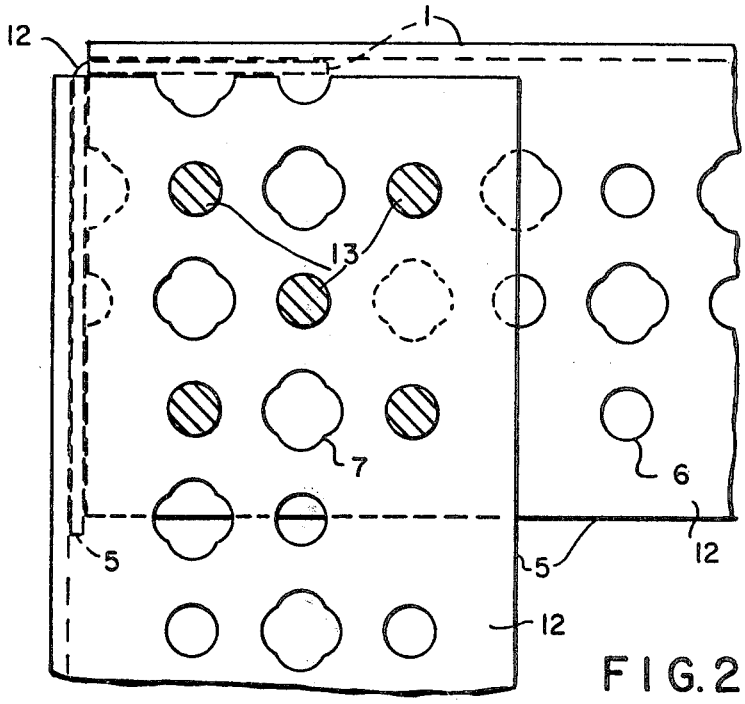
FIG. 25 is a view corresponding to FIG. 22 showing an elevation of a corner connection employing the constructional element of FIG. 5.

FIG. 25 is a view corresponding to FIG. 22 of a corner connection employing constructional elements of the type shown in FIG. 5 and using the same bolting pattern.

It will be evident that the connections illustrated in FIGS. 10 to 25 are all "lock joints" i.e. joints in which the fastener means, such as bolts, used in securing the connection are in bearing engagement with the edges of the apertures in the adjacent elements and are capable of withstanding bearing loads. Thus the improved constructional element of my invention is particularly suited to the fabrication of rigid structures which can withstand vertical and horizontal loadings or stresses. In no case is it necessary to resort to the use of "friction joints" i.e. joints wherein the fasteners are not in true bearing engagement in the apertures of the elements, but where the rigidity of the joint is dependent upon the frictional engagement between contacting flanges of adjacent elements of the joint, this frictional engagement being applied by the axial loading on the fasteners, such as bolts. In existing structural elements of the same general type many of the connections described above can only be achieved by employing frictional joints which have a lower strength than the preferred lock joints and which become unsatisfactory if any loosening of the fasteners occurs. The rigidity of structures fabricated with my elements, on the other hand, is not dependent upon the tightness of the bolts.

Furthermore the geometrical configuration and arrangement of the apertures in my preferred forms of constructional elements enable me to employ, in the various types of joints described, a greater number of fasteners in bearing than has hitherto been possible with any known form of constructional element. In the joint shown in FIG. 20, for example, I can insert a total of eight bolts in bearing (as illustrated by the cross-hatched circles), no fewer than five of these being received in round apertures in both flanges. If desired an additional four bolts in friction could be inserted in the quatrefoils of the vertical element.

This is considerably better than anything which can be achieved with any known design of constructional element of this type. It should be particularly noted that with my arrangement, where bolts as described as being "in bearing", they are in bearing both vertically and horizontally, and in contrast to some known arrangements do not simply offer bearing resistance to downwards vertical loads.

While it is preferred to employ circular holes in the rows of apertures, it will be appreciated that this is not essential. In place of the circular holes other forms could be used while still retaining some of the advantages of my invention. For example square holes having a side equal to the dimension of the bolt or fastener to be used, could be employed. Additionally some advantage of my invention could be gained by employing elements having apertures of the type described in only one of the two flanges, the other flange being left unperforated, or having an arrangement of apertures other than those described.

Furthermore it will be evident that, although I have described and illustrated elements having rows of apertures extending uniformly throughout their lengths, it would be possible to arrange the apertures in shorter rows at only selected locations in the length of an element.

What is claimed is:

1. A constructional element of constant L-shaped cross-section comprising two flanges of uniform thickness which merge at right angles in which one flange is wider than the other and wherein:

a. the narrower width flange contains a first longitudinally extending row of alternating circular and quatrefoil apertures;

b. the wider of said flanges contains an inner and at least one additional longitudinally extending row of alternating circular and quatrefoil apertures which have the same dimensions as the circular and quatrefoil apertures in said first row;

c. the apertures of each row in said wider flange are transversely aligned, the circular apertures in one row in said flange being transversely opposite the quatrefoil apertures in the other row in said wider flange, and wherein d. the centre lines of two rows of apertures in said wider flange are transversely spaced a distance equal to the centre-to-centre distance between adjacent apertures in any of said rows;

e. the lengthwise centre-to-centre distance between adjacent apertures in each row in each flange is the same;

f. the centre line of each row of apertures adjacent the line of merger of the two flanges is equidistant from said line of merger;

g. each quatrefoil aperture has a minimum dimension which is not less than the diameter of the circular apertures;

h. each quatrefoil aperture includes at least four arcuate curves, i. each quatrefoil aperture has two maximum dimensions, said maximum dimensions extending longitudinally and transversely of the element;

j. said transversely extending maximum dimension being substantially equal to the diameter of a circular aperture plus twice the thickness of said flange;

k. the aperture in each row being transversely aligned, the circular apertures in one row being transversely opposite the quatrefoil apertures in the next adjacent row, and wherein l. there is a small radius of curvature at the junction between the two flanges and in which the centre lines of each of said first row and said inner row of apertures are the same distance from the inner surface of the opposing flange, said distance in each one being equal to the sum of (a) the lengthwise centre-to-centre distance between adjacent apertures in said rows, plus (b) the thickness of said element, plus (c) said small radius;

m. the specified arrangement and configuration of holes being such that the two horizontal members may be joined to a vertical member to make a corner construction with the horizontal flanges of the horizontal members in face-to-face contact with one another and with at least three bolts in vertical and horizontal load bearing relationship supporting the horizontal members on the vertical member.

* * * * *